US005920021A

United States Patent [19]

Good

[11] Patent Number: 5,920,021

[45] Date of Patent: Jul. 6, 1999

[54] DRUM HEAD WITH SOUND ATTENUATING ANNULAR COATING

[75] Inventor: John J. Good, Thousand Oaks, Calif.

[73] Assignee: Drum Workshop, Inc., Oxnard, Calif.

[21] Appl. No.: 09/055,839

[22] Filed: Apr. 6, 1998

Related U.S. Application Data

[63] Continuation of application No. 08/652,270, May 23, 1996, abandoned.

[51] Int. Cl.[6] ..... G10D 13/02

[52] U.S. Cl. ..... 84/411 M; 84/414; 84/452 R

[58] Field of Search ..... 84/411 M, 411 R, 84/413, 414, 452 R, 452 P

[56] References Cited

U.S. PATENT DOCUMENTS

| | | | |
|---|---|---|---|
| 3,250,169 | 5/1966 | Stone, Jr. et al. . | |
| 4,018,944 | 4/1977 | Hallstrom et al. | 427/140 |
| 4,244,266 | 1/1981 | Hardy . | |
| 4,254,685 | 3/1981 | Rose . | |
| 4,282,793 | 8/1981 | Muchnick . | |
| 4,308,782 | 1/1982 | Hartry . | |
| 4,325,280 | 4/1982 | Hardy . | |
| 4,899,635 | 2/1990 | Santangelo . | |
| 5,091,248 | 2/1992 | Belli . | |
| 5,377,576 | 1/1995 | Good et al. | 84/411 R |

FOREIGN PATENT DOCUMENTS

| | | |
|---|---|---|
| 8103564 | 12/1981 | WIPO . |

*Primary Examiner*—William M. Shoop, Jr.
*Assistant Examiner*—Shih-yung Hsieh
*Attorney, Agent, or Firm*—William W. Haefliger

[57] ABSTRACT

A sound attenuating drum head that comprises a support ring, a synthetic membrane carried by the ring, a thin coating extending in an annular direction on the membrane, and acting to attenuate vibration of the head, when struck.

11 Claims, 4 Drawing Sheets

DRUM HEAD WITH SOUND ATTENUATING ANNULAR COATING

This application is a continuation of application Ser. No. 08/652,270, filed May 23, 1996, abandoned.

BACKGROUND OF THE INVENTION

This invention relates generally to drumming apparatus, and more particularly to an apparatus associated with a drum, such as a tom-tom, for sound attenuating a drum head with desired acoustic effects.

There is need for improved, simple, effective means to achieve desired drum sound effects, such as sound attenuation, when the drum head is struck with a beater, such as a drum stick.

SUMMARY OF THE INVENTION

It is a major object of the invention to provide improved apparatus meeting the above needs. Basically, the improved apparatus or device of the invention comprises:

a) a support ring, b) a synthetic membrane carried by the ring, c) a thin coating extending in an annular direction on the membrane, and acting to attenuate vibration of the head, when struck.

Another object includes the provision of abrasive particles in said coating, the coating extending annularly relative to the head, which is disc shaped. The coating may extend annularly continuously, as will be seen.

A further object includes provision of a drum casing or shell supporting the membrane, outwardly of the annularly extending coating. The shell is typically annular and has an edge annularly engaging the membrane at one side thereof, the coating located at the opposite side of the membrane.

Yet another object includes provision of flange structure transmitting clamping loading to the opposite side of the membrane, at the periphery thereof, to tension the membrane.

It is found that the provision of such a thin coating on the drum head, attached to a drum, serves to attenuate the sharp, metallic sound produced by the drum when the head is struck by a drum stick, while leaving or providing a large, uncoated area of the head, to be struck in normal fashion.

These and other objects and advantages of the invention, as well as the details of an illustrative embodiment, will be more fully understood from the following specification and drawings, in which:

DRAWING DESCRIPTION

DETAILED DESCRIPTION

Figure 1:
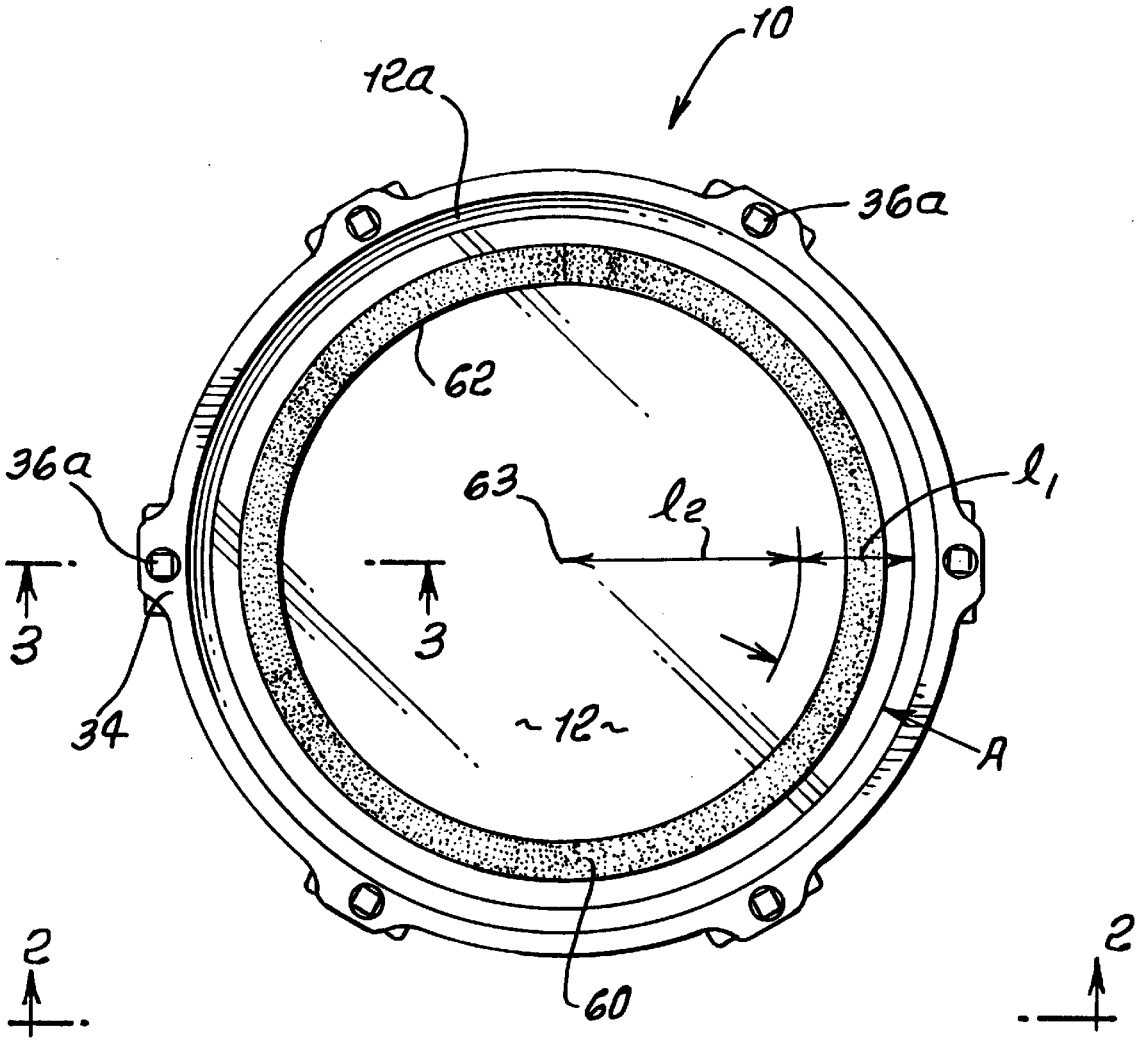
FIG. 1 is a top plan view of a drum head, incorporating the invention.

In the drawings, a drum 10 has a shell 11 comprising a cylindrical section or sections located in axially extending position. Drum 10 may be a tom-tom.

Figure 3:
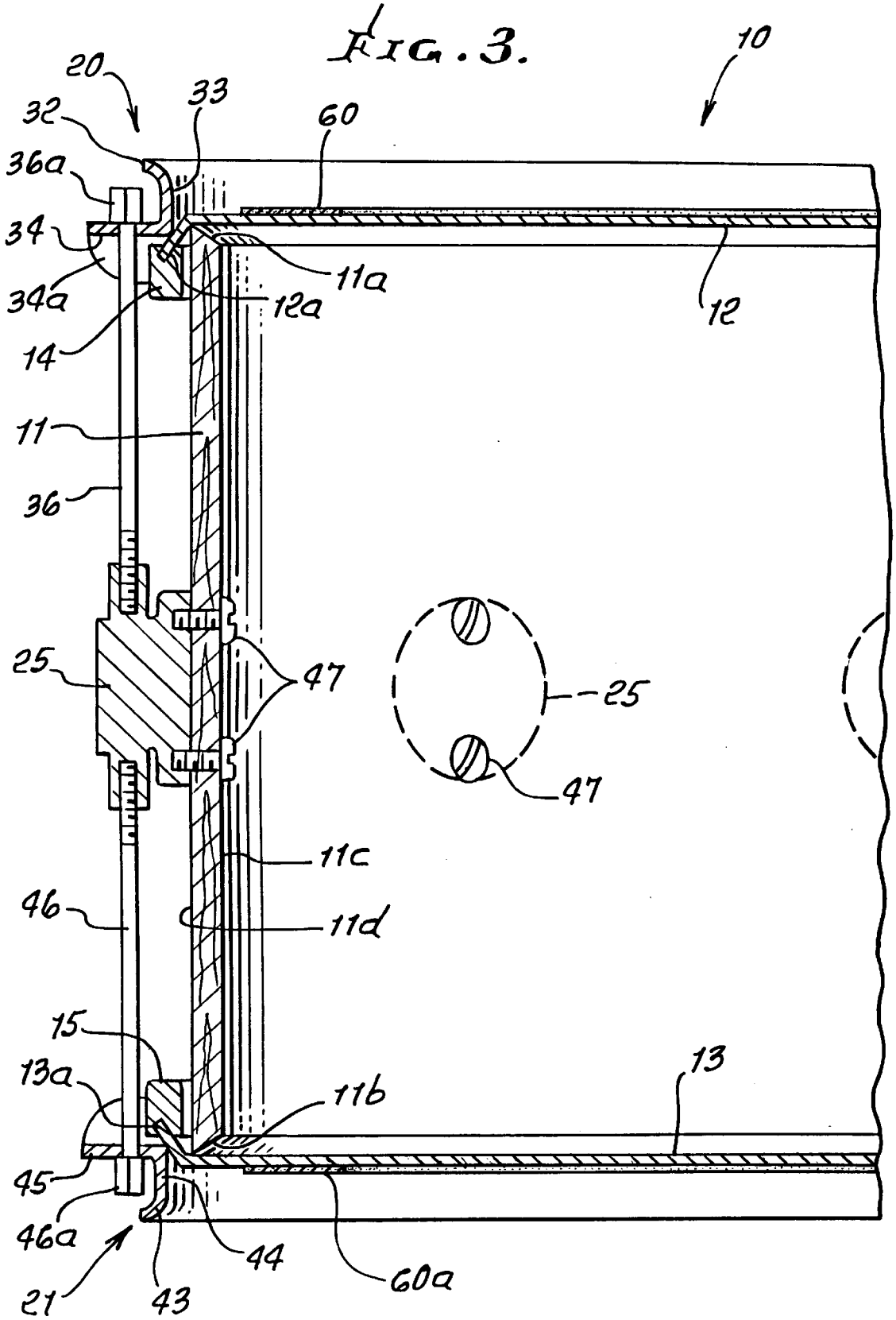
FIG. 3 is an enlarged vertical section taken on lines 3—3 of FIG. 1.

Opposite annular and inwardly angled ends of the shell appear at 11*a* and 11*b* in FIG. 3. The shell typically consists of wood and has inner and outer cylindrical walls 11*c* and 11*d*.

Drum heads 12 and 13 extend over the shell ends 11*a* and 11*b* and are retained in taut condition. They may consist of thin sheets of synthetic, resinous plastic or other material (one example being MYLAR) that produces a sharp sound when struck, and needing attenuation. Annular metallic flanges or rings 14 and 15 are typically attached to the angled edge extents 12*a* and 13*a* of the respective heads 12 and 13 for retaining them in taut condition. Flanges 14 and 15 extend about opposite end extents of the shell, as seen in FIG. 3.

The retainer structure shown includes flange structure 20 provided in association with one end 11*a* of the shell, and flange structure 21 in association with the other end 11*b*of the shell.

Figure 2:
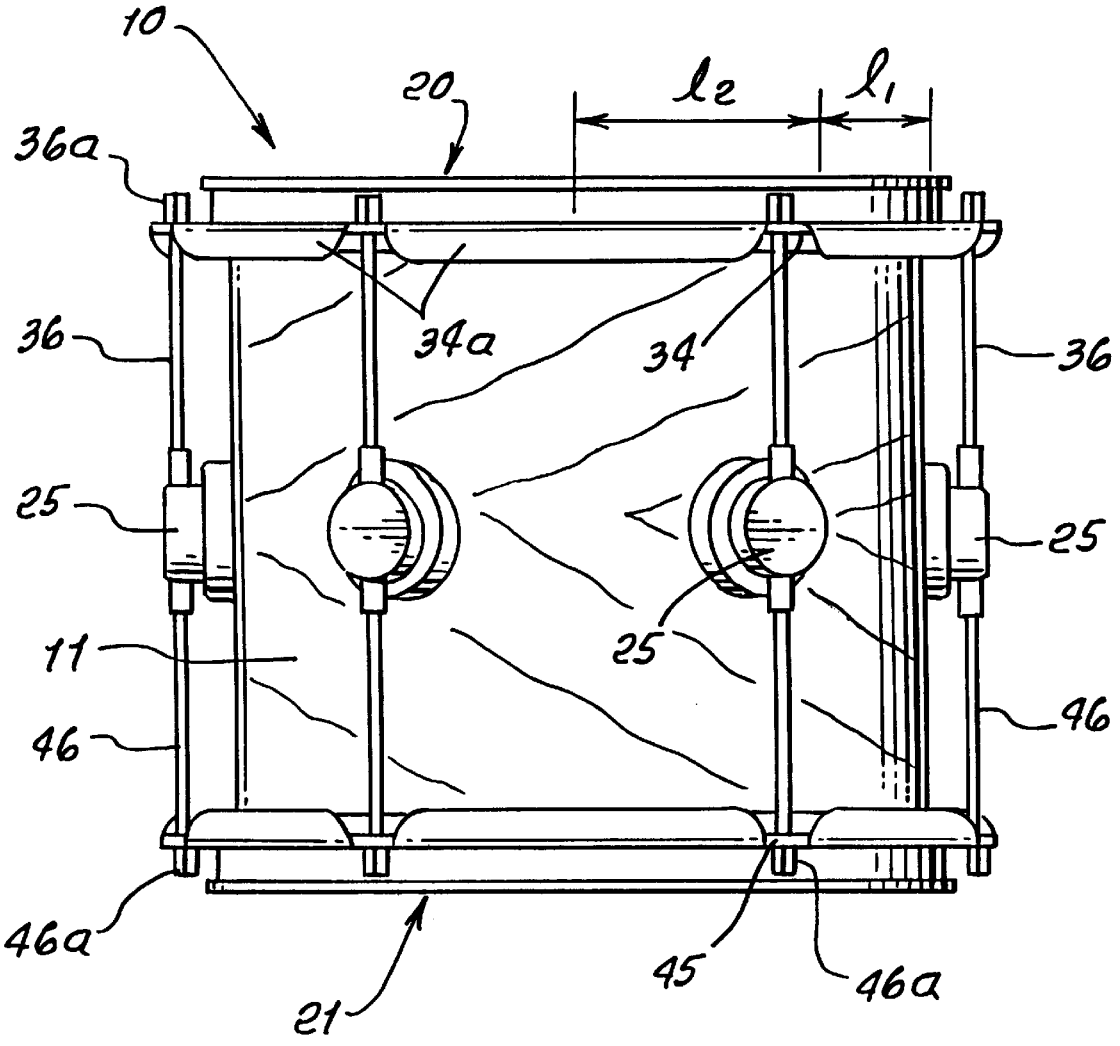
FIG. 2 is a side elevational view of the FIG. 1 drum incorporating the invention.

In one drum example, the upper flange structure 20 has an upwardly extending annular rim portion 32 extending above the level of drum head 12, a medial annular portion 33 extending radially outwardly below the level of 32, for transmitting head tightening loading to flange 14, and a lower annular extending portion 34 extending radially from the lower extent of 33. That portion has integral downwardly extending ribs 34*a*. A tightening adjustment fastener rod 36 extends downwardly through 33 and has external threads that interfit upper internal threads in holder or stud 25. Note fastener head 36*a* bearing on the upper surface of 34 in FIG. 2. The lower surface of 33 exerts downward loading onto downwardly deflected or angled annular edge portion 12*a* of 12, attached to retention ring or flange 14, for adjusting the tautness of head 12, by drawing the head over the upper edge of 11*a*.

Likewise, lower flange structure 21 has a downwardly extending annular rim portion 43 extending below the level of drum head 13, a medial annular portion 44 extending radially outwardly above the level of 43 for transmitting head tightening loading, and an upper annularly extending portion 45 extending radially from upper extent of 44. See upwardly angled edge portion 13*a* of 13, attached to ring 15. A tightening adjusting fastener rod 46 extends upwardly through 44 and has external threads that interfit rotatably lower internal threads in holder or stud 25. Note fastener head 46*a* bearing upwardly on the lower surface of 44. The upper surface of 44 exerts upward loading onto head edge portion 13*a,* attached to lower retention ring or flange 15, for adjusting tautness of head 13, i.e., over lower edge of bevel 11*b*. Fasteners connect 25 to 11 at 47. Accordingly, the drum heads are individually adjustable, while the drum heads are stretched over metal edges, with acoustic benefits; however, it is sometimes desirable to provide for attenuation or softening of the sharp, metallic sound created by beater stick impact on the drum head.

In accordance with an important aspect of the invention, sound attenuating structure is provided in direct association with one and/or both of the heads 12 and 13. Such structure is in the form of a thin coating, as for example at 60, extending in an annular direction on at least one head, and acting to attenuate vibration of that head, when struck as by a drum stick. Typically, the coating may consist of a carrier, and abrasive particles in the carrier, which is bonded to the head. In one example, the head may comprise a membrane consisting of synthetic, resinous material, such as MYLAR.

The carrier may consist of solvent base material, or epoxy resin; and the abrasive particles filled into the carrier consist of fillers, or of glass frit.

The coating is shown as forming an annular band, confined in annular zone A of radial length $l_1$, within the outermost 40% of the head overall radius. Thus, radial length $l_2$, as measured from the head center 63, subtends 60% of the overall radius and lies radially inwardly of the inner edge 62 of that band. This assures that at least 60% of the head overall radius, and also diameter, is substantially uncoated, and is available to be struck by a drum stick, whereby the drum stick does not strike the coating during normal drum playing.

The thickness of the coating band is preferably within the range 3 mm to 3.2 mm inches; and the radial overall dimension of the band is preferably within the range 0.5 and 1.0 inches.

A similar or like band 60*a* is or may be applied to the head 13, which is like head 12, whereby both heads are substantially alike.

Figure 4:
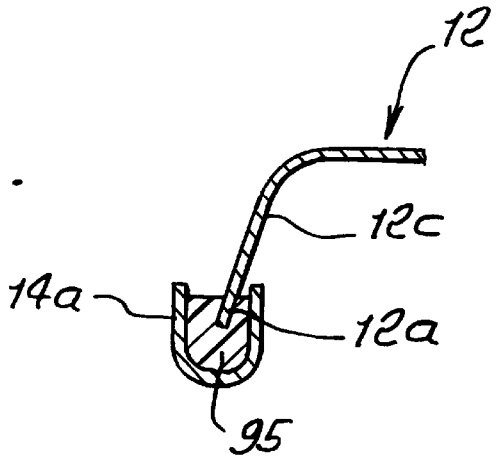
FIG. 4 is an enlarged section showing alternative support for the drum head.

FIG. 4 shows an alternative ring support at 14*a* for the edge of the membrane 60. Support ring 14*a* is metallic and is channel shaped, as shown. The edge 12*a* of the stiff-turned or angled annular portion 12*c* of head 12 is received in the channel and bonded to the channel, as by hardened bonding material 95 in the channel.

Figure 5:
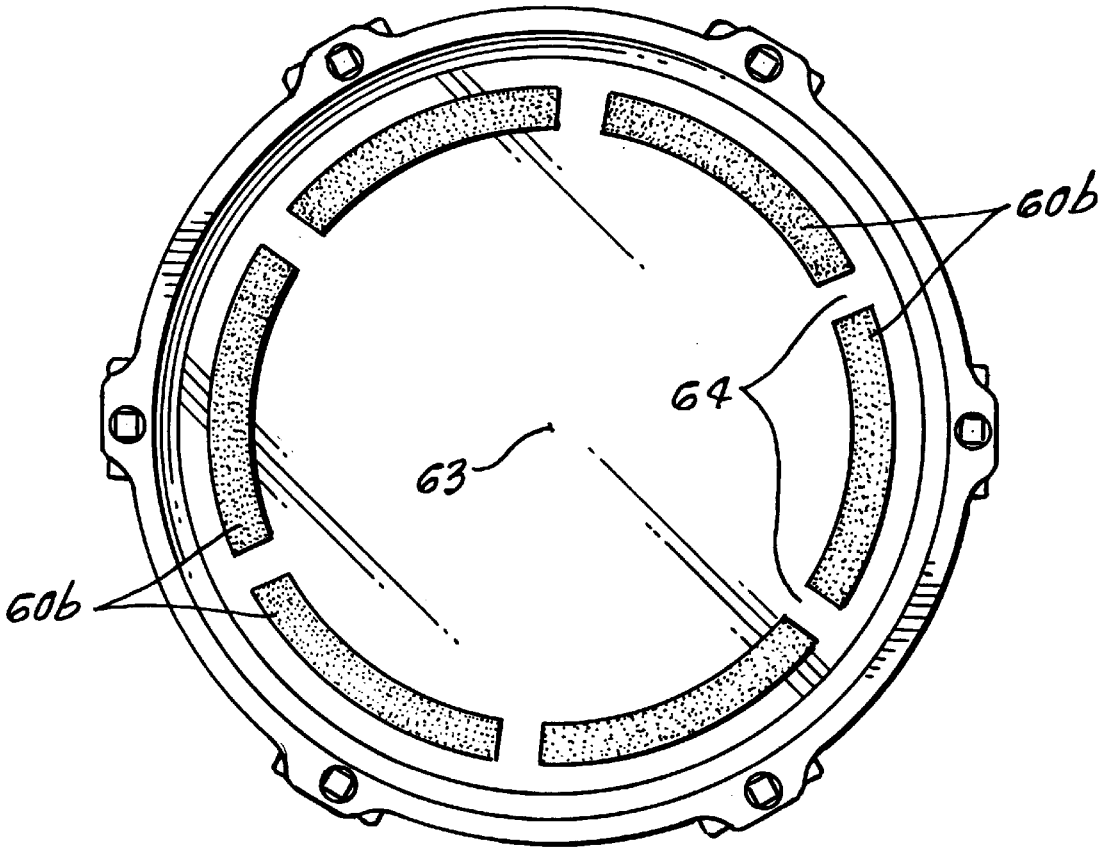
FIG. 5 is is a view like FIG. 1 showing a modification.

FIG. 5 shows a head on which the sound-attenuating coating material is discontinuous, i.e., is in segments 60*b*, spaced apart at 64 about the center 63 of the head.

I claim:

1. A sound attenuating drum head, the combination with a drum shell comprising:

a) a support ring, b) a synthetic membrane carried by the ring, said drum shell supporting the membrane, c) a thin coating extending in an annular direction on the membrane, and acting to attenuate vibration of the head, when struck, said coating consisting of epoxy resin and abrasive filler particles, the resin directly bonded to said membrane, d) said coating having thickness within the range 3 mm to 3.2 mm, e) the coating having substantially the form of an annularly extending band with an overall radial dimension within the range 0.5 and 1.0 inches, f) said ring having an edge annularly engaging the membrane, said coating spaced radially from, but proximate to, said edge, g) said shell being annular, said membrane having an inside and an opposite side, said ring edge engaging the membrane at said inside thereof, said coating located at said opposite side of the membrane, h) said band containing particulate material that includes glass frit, and i) said band is within an annular zone on the head, which lies outwardly of 60% of the head radius as measured from the center of the head.

2. The combination of claim 1 wherein said coating contains abrasive particles.

3. The combination of claim 1 wherein said coating extends annularly continuously.

4. The combination of claim 1 wherein said shell is annular and has an edge annularly engaging the membrane at inside thereof, said coating located at the opposite side of the membrane.

5. The combination of claim 4 including flange structure transmitting clamping loading to said opposite side of the membrane, at the periphery thereof, to tension the membrane.

6. The combination of claim 4 wherein said coating is spaced radially from said edge.

7. The combination of claim 1 wherein the coating is in the form of a thin band adherent to the head, said band containing particulate material.

8. The combination of claim 7 wherein the band is within an annular zone on the head, which lies outwardly of 60% of the head radius as measured from the center of the head.

9. The combination of claim 1 including a second drum head membrane covered by the shell, and a second sound attenuating coating on the second membrane, and extending in an annular direction thereon.

10. The combination of claim 1 wherein the coating extends in segments spaced apart about the center of the drum.

11. The combination of claim 1 wherein said coating is everywhere spaced substantially radially inwardly from said ring edge.

* * * * *